United States Patent [19]

Kai et al.

[11] 4,075,767

[45] Feb. 28, 1978

[54] POWDER PRODUCING APPARATUS

[75] Inventors: Fumindo Kai, Tachikawa; Eitaro Kumazawa, Sayama; Yozo Ishioka, Higashikurume, all of Japan

[73] Assignee: Snow Brand Milk Products Co., Ltd., Sapporo, Japan

[21] Appl. No.: 707,558

[22] Filed: Jul. 22, 1976

[30] Foreign Application Priority Data

Aug. 7, 1975 Japan ..... 50-96168

[51] Int. Cl.[2] ..... F26B 13/30

[52] U.S. Cl. ..... 34/92; 34/15

[58] Field of Search ..... 34/5, 15, 92

[56] References Cited

U.S. PATENT DOCUMENTS

| | | | |
|---|---|---|---|
| 2,150,684 | 3/1939 | Hickman | 34/15 |
| 2,523,552 | 9/1950 | Birdseye | 34/5 |
| 3,266,169 | 8/1966 | Smith, Jr. | 34/92 X |
| 3,421,229 | 1/1969 | Kniese | 34/5 X |

*Primary Examiner*—John J. Camby

*Attorney, Agent, or Firm*—Stevens, Davis, Miller & Mosher

[57] ABSTRACT

Vacuum type powder producing apparatus comprising an endless belt passing around a pair of vertically spaced rollers to provide a downward and upward runs, a vacuum chamber encircling only the downward run of the belt. Slurry of material is applied to the belt surfaces at the inlet end of the vacuum chamber and dried in the chamber under vacuum. Suitable belt cleaning device is provided outside the vacuum chamber.

5 Claims, 1 Drawing Figure

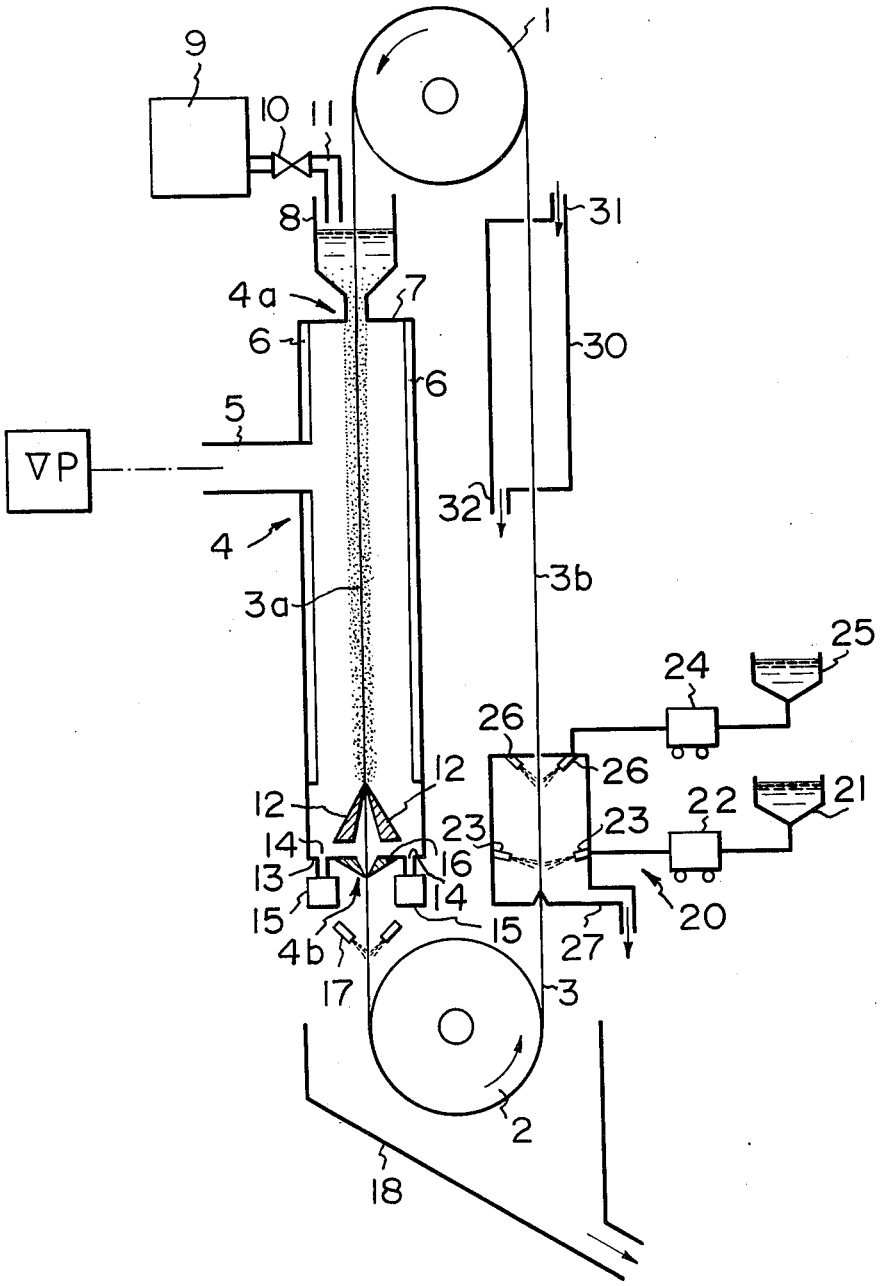
1
9
10
11
8
31
4a
7
6
30
6
5
∇P
32
4
3b
3a
25
24
26
26
12
12
22
21
14
23
23
13
16
14
15
15
20
4b
27
17
3
2
18

POWDER PRODUCING APPARATUS

The present invention relates to a powder forming apparatus. More particularly, the present invention relates to an apparatus for producing powdery material from liquefied slurry.

Conventionally, in order to produce powders from viscous slurry including highly heat sensitive material such as milk, coffee, juice of fruits, soyabean juice or the like, it has been a general practice to make the slurry dry under a vacuum. Continuous means for producing powders in this way includes a vacuum drying apparatus and a vacuum foaming dryer. These types of apparatus generally include an endless belt totally disposed in a vacuum chamber and slurry to be treated is applied to the surface of the belt to be dried under heat. It has been found, however, that these types of arrangements are undesirable because the endless belt is totally housed in the vacuum chamber so that an unnecessarily large vacuum space is required.

It has also been common to employ a vacuum freezing dryer for the purpose. However, this type of apparatus is disadvantageous in that it requires a stronger vacuum and that the process must be used to produce batches.

It is therefore a primary object of the present invention to provide an improved apparatus for producing powdery material under vacuum.

Another object of the present invention is to provide a compact and efficient apparatus for producing powdery material from slurry.

A further object of the present invention is to provide a vacuum type powder forming apparatus which requires less vacuum space than in a conventional apparatus.

According to the present invention, the above and other object can be accomplished by a vacuum type powder producing apparatus comprising endless belt means passing around at least a pair of spaced roller means to provide at least two belt runs, vacuum chamber means encircling one of the belt runs and having inlet and outlet means for allowing the belt means to pass therethrough into and out of the vacuum chamber means, means for applying a vacuum to the vacuum chamber, means for applying slurry of a material to said belt means at such a location that the slurry can be maintained in the vacuum chamber for a time sufficient for drying the material, means for scraping the dried material off the belt means, means provided outside the vacuum chamber for cleaning the belt means. Most preferably, means may be provided for drying the belt means after cleaning.

According to one aspect of the present invention, the belt means are arranged in vertical direction so as to provide a vertical downward run and a vertical upward run, and the vacuum chamber means is provided to encircle the downward run of the belt. Therefore, an inlet and outlet openings are formed in the vacuum chamber at the upper and lower ends thereof to allow the belt to pass therethrough. The slurry applying means is provided at the inlet opening at the upper end of the vacuum chamber in the form of a slurry storing tank and the belt is passed through the tank into the vacuum chamber. This arrangement is advantageous in that sealing means can be omitted at the inlet opening of the vacuum chamber.

The above and other objects and features of the present invention will become apparent from the following descriptions of a preferred embodiment taking reference to the accompanying drawing which is a diagrammatical sectional view of the powder forming apparatus in accordance with the present invention.

Referring to the drawing, the apparatus shown therein includes a pair of rollers 1 and 2 which are spaced apart in vertical direction. An endless belt 3 is stretched between the rollers 1 and 2 and has a downward run **3*a* and an upward run 3*b*. One or both of the rollers 1 and 2** are driven by motor means (not shown) in the direction shown by arrows in the drawing.

Around the lower run **3*a* of the belt 3, there is provided a vacuum chamber 4 to encircle the belt run 3*a*. The vacuum chamber 4 has an upper end wall 7 formed with an inlet 4*a* and a lower end wall 13 formed with an outlet 4*b* to allow the belt to pass therethrough into and out of the chamber 4. The chamber 4 is provided with a duct 5 which is connected to a vacuum pump VP for drawing air and vapor from the chamber 4 so that the inside of the chamber 4 is maintained at a vacuum of 5 to 20 Torr. As shown in the drawing, the downward run 3*a* of the belt 3 passes through the chamber 4 and heaters 6 are provided in the chamber 4 to apply heat to the slurry on the surfaces of the belt 3**.

The vacuum chamber 4 is provided at its inlet **4*a* with a slurry storing tank 8 through which the belt 3 is passed into the chamber 4. A slurry reservoir 9 is provided for supplying gas or bubble containing slurry of a material to the tank 8 through a conduit 11 having a valve 10 so that the tank 8 is filled with such slurry to a desired level. Therefore, the belt 3 was slurry material applied to its opposite faces as it passes through the tank 8. The inlet 4*a*** is in the form of a slit and the thickness of the slurry coatings thus applied to the belts surfaces can be determined by the width of the slit and/or the moving speed of the belt.

The slurry material applied to the belt 3 is subjected to vacuum in the chamber 4 whereby the bubbles in the slurry are rapidly expanded. As the belt 3 moves in the vacuum chamber 4, the slurry on the belt 3 is dried under heat applied by the heaters 6.

In the vacuum chamber 4, there are provided adjacent to the outlet **4*b* a pair of scraping blades 12 for co-operation with the opposite surfaces of the belt 3 so as to scrape the dried material off the belt 3 onto the lower end wall 13. The vacuum chamber 4 is provided at its lower wall 13 with take out ports 14 having suitable sealing means. The ports 14 are associated with powder tanks 15 so that the dried material is taken out through the ports 14 into the tanks 15**.

At the outlet **4*b* of the vacuum chamber 4, there is provided an appropriate sealing device such as resilient sealing strips 16 which are in sliding engagement with the opposite surfaces of the belt 3 which is passing through the outlet 4*b***.

Beneath the outlet **4*b* of the vacuum chamber 4, there is provided pre-cleaning means in the form of water spraying nozzles 17 which apply cleaning water jets to the surfaces of the belt 3 to remove residual powder therefrom. Water collecting pan 18 is provided for receiving water which has been used for cleaning the belt 3**.

Along the upward run **3*b* of the belt 3, there is provided a second or main cleaning device 20 which includes detergent spray nozzles 23 and water spray nozzles 26. A detergent reservoir 21 is connected through a high pressure pump 22 to the spray nozzles 23. Similarly, a water reservoir 25 is connected through a high pressure pump 24 with spray nozzles 26. Thus, the belt 3 is sprayed as it passes through the cleaning device 20 with detergent discharged from the spray nozzles 23 and then with water sprayed from the nozzles 26. If necessary, the cleaning device 20 may include power driven rotatable brushes for removing residual material from the belt surfaces. The detergent and water which have been used for the cleaning are discharged through a conduit 27**.

Downstream of the second cleaning device 20, there is provided a drying chamber 30 which has an inlet 31 for drying air and an outlet 32. Suitable means is of course provided for supplying the drying air to the inlet 31 of the drying chamber 30.

The arrangement of the present invention is advantageous in that the vacuum chamber is provided only along one of the belt runs so that the vacuum chamber can be of substantially smaller volume than that of the prior art. Since the belt rollers and the driving mechanism therefor are totally provided outside the vacuum chamber, they are readily accessible for maintenance. It should further be noted that the belt can be very conveniently cleaned at the portion outside the vacuum chamber.

The invention has thus been shown and described with reference to a specific embodiment, however, it should be noted that the invention is in no way limited to the details of the illustrated arrangements but changes and modifications may be made without departing from the scope of the appended claims; for example, heaters may be embedded in the belt which may in this case be made of a steel material. Alternatively, the belt may be constituted by flexible tube members which include heaters therein.

We claim:

1. Vacuum type powder producing apparatus comprising endless belt means passing around at least a pair of spaced roller means to provide at least two belt runs, vacuum chamber means encircling one of the belt runs and having inlet and outlet means for allowing the belt means to pass therethrough into and out of the vacuum chamber means, means for applying a vacuum to the vacuum chamber, slurry tank means provided in said inlet means of the vacuum chamber means so that said belt means is passed through the slurry tank means whereby slurry is deposited on both sides of the belt means when it passes through the slurry tank means, means for applying slurry to the tank means so that the slurry is maintained therein to a level sufficient to provide a sealing effect at the inlet means of the vacuum chamber means, means for scraping the dried material off the belt means, means provided outside the vacuum chamber for cleaning the belt means.

2. Apparatus in accordance with claim 1 in which means is further provided downstream side of the belt cleaning means for drying the belt means.

3. Apparatus in accordance with claim 1 in which said pair of roller means are spaced apart in vertical direction to provide a vertical downward belt run and a vertical upward belt run.

4. Apparatus in accordance with claim 1 in which said scraping means is provided in the vacuum chamber means at a lower portion thereof.

5. Apparatus in accordance with claim 4 in which means is further provided at lower end of the vacuum chamber means for taking out powder material which has been scraped off the belt means.

* * * * *